US005239840A

United States Patent [19]

Sutterlin

[11] Patent Number: 5,239,840

[45] Date of Patent: Aug. 31, 1993

[54] DECORATIVE INSERT FOR ARTIFICIAL FINGERNAILS

[76] Inventor: Karl Sutterlin, Mechanische Werkstatt Luzernerstrasse, CH-6016 Hellbuhl, Switzerland

[21] Appl. No.: 768,929

[22] PCT Filed: Dec. 4, 1990

[86] PCT No.: PCT/CH90/00279

§ 371 Date: Oct. 3, 1991

§ 102(e) Date: Oct. 3, 1991

[87] PCT Pub. No.: WO91/07891

PCT Pub. Date: Jun. 13, 1991

[30] Foreign Application Priority Data

Dec. 6, 1989 [CH] Switzerland ..... 4388/89-8

[51] Int. Cl.[5] ..... A44C 25/00

[52] U.S. Cl. ..... 63/2

[58] Field of Search ..... 63/2, 26, 1.1

[56] References Cited

U.S. PATENT DOCUMENTS

| | | | |
|---|---|---|---|
| 1,238,046 | 8/1917 | Nuss | 63/2 |
| 1,368,065 | 2/1921 | Sorensen . | |
| 2,013,290 | 9/1935 | Rohrbach | 63/2 |
| 4,107,947 | 8/1978 | Saito | 63/2 |
| 4,498,314 | 2/1985 | Okamura | 63/2 |

FOREIGN PATENT DOCUMENTS

| | | | |
|---|---|---|---|
| 0062746 | 10/1982 | European Pat. Off. . | |
| 21439 | 9/1905 | Fed. Rep. of Germany | 63/2 |
| 883975 | 7/1953 | Fed. Rep. of Germany . | |
| 2719378 | 6/1978 | Fed. Rep. of Germany . | |
| 1037217 | 5/1951 | France | 63/2 |
| 1310161 | 12/1961 | France | 63/2 |
| 1067070 | 11/1962 | France | 63/2 |
| 2595925 | 3/1986 | France . | |

*Primary Examiner*—Renee S. Luebke
*Assistant Examiner*—Flemming Saether
*Attorney, Agent, or Firm*—Speckman & Pauley

[57] ABSTRACT

A detachable decorative insert which is insertable in an artificial fingernail fitted with a securing aperture. A cylindrical base of the decorative insert is designed to fit in the securing aperture where the decorative insert or a carrier for it is arranged on the base, the lower edge of which projects slightly beyond the base in a radial direction and forms two peripheral continuous S-curves along the outer surface of the base. A base foot has an outer surface which projects radially beyond the base on two opposite sides.

10 Claims, 3 Drawing Sheets

FIG. 3
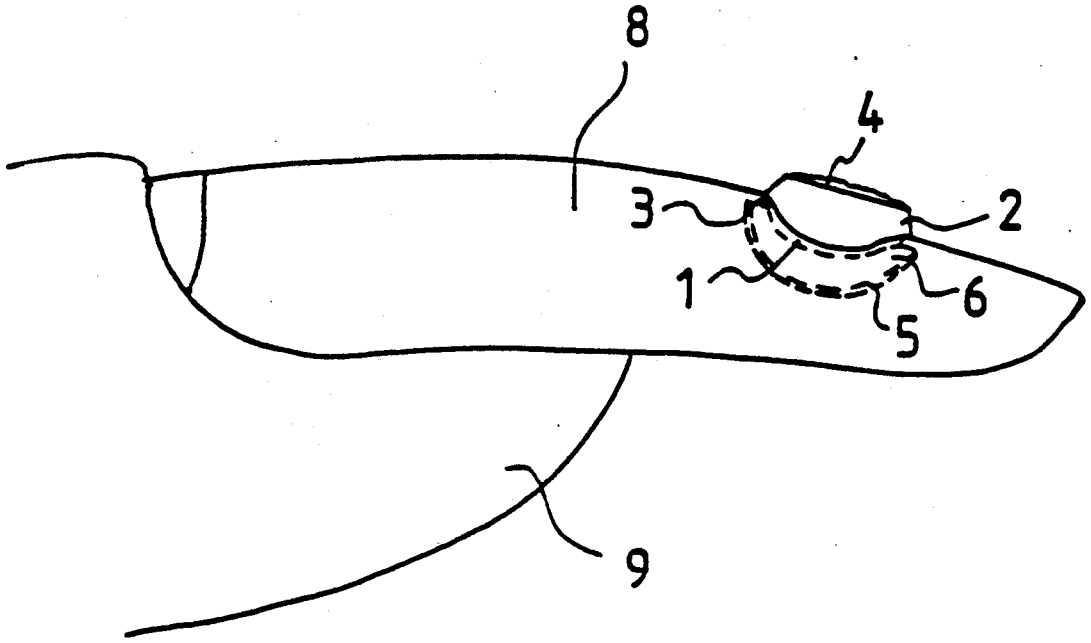
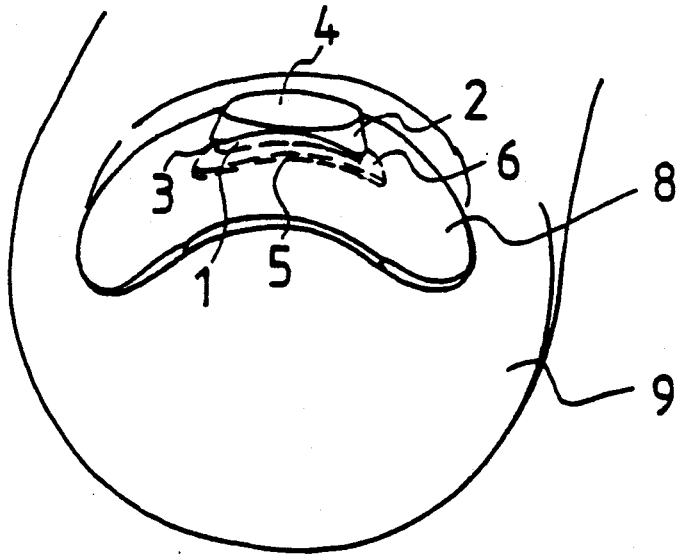
FIG. 4

DECORATIVE INSERT FOR ARTIFICIAL FINGERNAILS

BACKGROUND OF THE INVENTION

1. Field of the Invention

This invention relates to a decorative insert for artificial fingernails. Artificial fingernails are offered by the cosmetics industry in an enormous diversity of shapes, colors and sizes. They are glued to the natural nails and are intended to add to the well-groomed appearance of the fingers of the wearer. As a rule, artificial fingernails are markedly long and therefore extend by about 5 to 15 mm beyond the tip of the finger. Artificial fingernails are know which are made of transparent plastic and include a magnifying glass formed as one piece of the same material in the tip of the fingernail. Such a magnifying glass is used as a decoration and can also serve as an aid to reading. It is also know to wear expensive and real pieces of jewelry as decorations on the tips of the artificial fingernails. Up to now, suitable gems were glued to the nails. However, gluing entails great efforts and there is the danger of the glue becoming undone and the jewelry being lost. Consequently there is to-date no precious jewelry which could be worn on such an artificial fingernail.

SUMMARY OF THE INVENTION

Description of the prior Art

It is therefore the object of this invention to provide a decorative insert for artificial fingernails which is simple and quick to manipulate and remains securely in the nail after insertion, so that there is no danger of losing the jewelry.

This object is attained by a decorative insert for artificial in accordance with this invention which is inserted immovably in an artificial fingernail provided with an insertion hole.

BRIEF DESCRIPTION OF THE DRAWINGS

Several embodiment in accordance with this invention are illustrated in the drawings which are described in detail in the following description.

FIG. 3 is a side view a decorative insert, in accordance with one embodiment of this invention inserted into a fingernail;

FIG. 4 is a front view of a decorative insert in accordance with one embodiment of this invention inserted into a fingernail;

DESCRIPTION OF PREFERRED EMBODIMENTS

Figure 1:
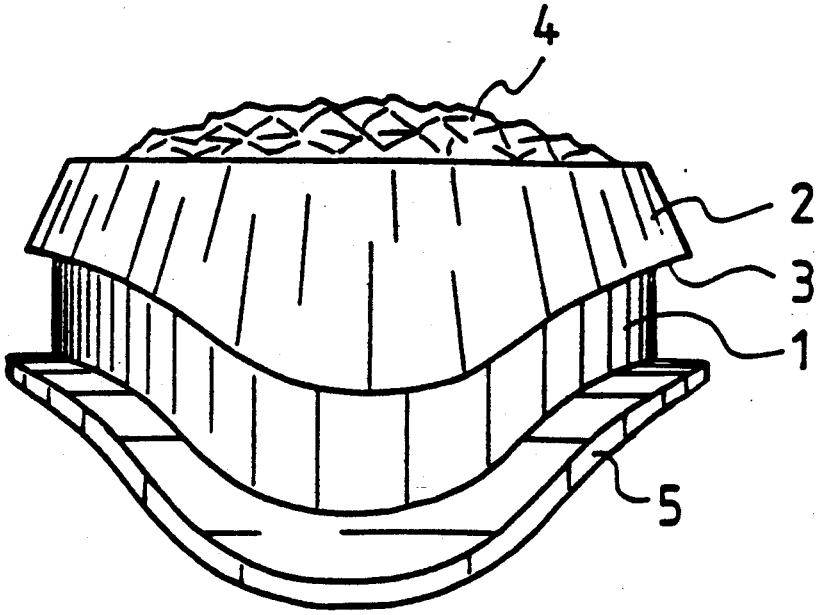
FIG. 1 is a side view of a decorative insert in accordance with one embodiment of this invention.

A side view of a decorative insert in accordance with one embodiment of this invention is illustrated in FIG. 1. The decorative insert is designed to be inserted into an insertion hole in the front area of an artificial fingernail. For this purpose, the insert is provided with means for the immovable insertion into such an insertion hole. The means for immovable insertion in accordance with one embodiment of this invention comprise a decorative insert having a centered cylindrical base 1, which also has a circular diameter. The upper part 2 of the decorative insert in the form of a decorative or a support for a decoration is seated on the base 1 and slightly extends radially over the cylindrical peripheral surface of the base 1 with its lower edge 3. The upper part 2 of the decorative insert, seated on the in accordance with one embodiment of the invention may constitute the decoration itself, having been carved out of the surface However, the surface of the upper part 2, in accordance with another embodiment of this invention may also have a plane or cashed blank surface which is suitable for engraving. As shown in FIG., the upper part 2 is embodied as a support for a decoration or as a mounting for jewelry. To this end, it has a blind bore into which the decoration or the jewel 4 are inserted. The lateral surface of the upper part 2 is slightly inwardly inclined towards the top, so that a cone is formed. The diameter of the cone tapers to a size which is less than that of the diameter of the base. The base 1 has a foot 5, with an upper edge 6 which extends slightly beyond the base 1 in a radial direction. The lower edge of the upper part 2 and the upper edge 6 of the foot 5 each extend peripherally along the outside of the base and each forms two connecting S-curves.

Figure 2:
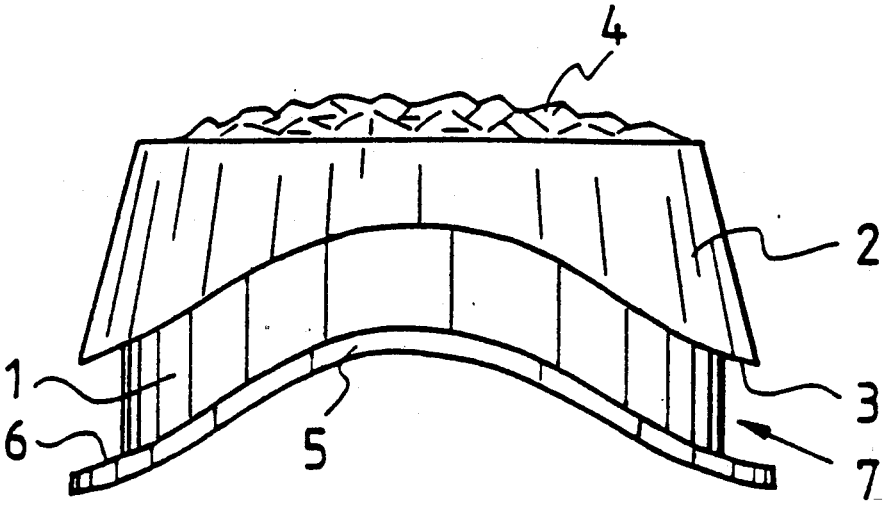
FIG. 2 is a front view a decorative insert in accordance with the embodiment shown in FIG. 1.

FIG. 2 shows a front view the decorative insert in accordance with the embodiment shown in FIG. 1. The conical exterior of the decorative upper part 2 and the jewel 4 inserted into the top are clearly visible. The lower edge 3 of the upper part 2 extends parallel to the upper edge 6 of the base foot 5. Both lower edge 3 and upper edge 6 are curved around a radius which corresponds to that of the cross-sectional curvature of the artificial fingernail into which the decorative insert is placed. Because of the conical shape of the decorative upper part 2, the decorative insert can be pressed from below through a prepared hole in the artificial fingernail. As a result of the pressing-in of the decorative insert, the artificial fingernail is slightly stretched or widened, causing the radius of curvature of its lateral curvature to be slightly widened. In addition, the hole in the artificial fingernail is slightly enlarged and the conical upper part 2 of the decorative insert can be pressed entirely through he hole. After passage of the lower edge 3 of the upper part 2, the artificial fingernail snaps into the groove 7 formed by the lower edge 3, the wall of the cylindrical base 1 and the upper edge 6 of the base foot 5. As a result, the stretching of the fingernail is released and the decorative insert now is seated securely and immovably in the hole in the artificial fingernail lower edge. The 3 and lower edge 6 rest on the artificial fingernail material and thus secure the decorative insert.

FIG. 3 shows a lateral view of a decorative insert in accordance with one embodiment of this invention placed into an artificial fingernail 8. The decorative insert is preferably placed into the artificial fingernail 8 of the little finger 9, because it is least stressed there and the artificial fingernail of the little finger 9 also appears as the most delicate. It is of course also possible to produce decorative inserts, the curvature at the edge of which is greater and which are therefore suitable for insertion into the more flatly shaped fingernail of the other fingers, even for the thumb.

FIG. 4 shows a front view of an inserted decorative insert in accordance with the invention. It can be seen that the lower edge 3 of the upper part 2 and the upper edge 6 of the base foot edge 5 are formed to follow the curvature of the artificial fingernail and thus the decorative insert is securely maintained in the artificial fingernail.

Figure 5:
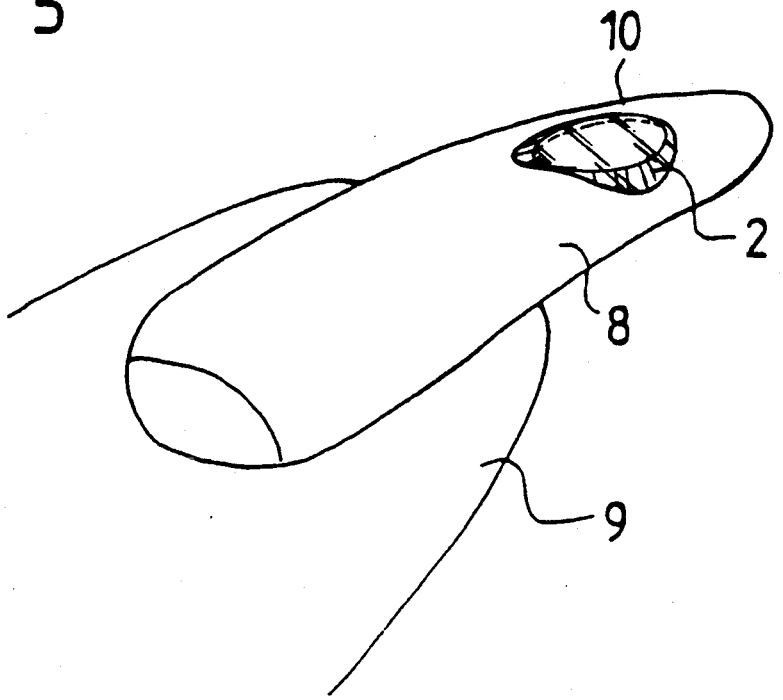
FIG. 5 shows a decorative insert in accordance with one embodiment of this invention in the form of a magnifying glass.

In accordance with another embodiment of this invention shown in FIG. 5, the decorative insert may be embodied as a magnifying glass 10. The upper part 2 as well as the base and the base foot are provided with a centered bore forming a hollow cylinder and a small magnifying glass 10 has been inserted into the interior of this cylinder. On the one hand, it acts as a decoration, the upper part 2 forms a nicely decorated edge for the magnifying glass 10. On the other hand, the magnifying glass may be used for reading small print. All that is then required is to pass the appropriate finger across the printed text and the letters are shown enlarged through the magnifying glass, as shown in FIG. 5.

Figure 6:
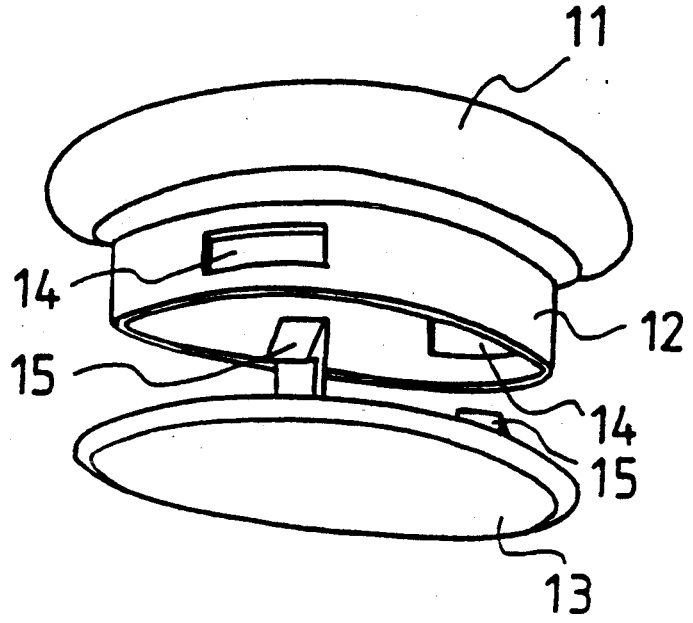
FIG. 6 a two-piece decorative insert.

The base foot of the decorative inset in accordance with invention embodiment of this as shown in FIG. 6 may also be a separate part, which can be placed on the base from below or inserted into the base 12, where means 14, 15 for interlocking base 12 and base foot 13 are provided on the base 12 and the base foot 13 which can be positively interlocked with each other. The upper part 11 advantageously comprises metal and is connected as one piece to the base 12. The upper part 11 does not necessarily taper conically towards the top. On the contrary, the upper part 11 may have the shape shown, or may even clearly increase in diameter towards the top. This upper part 11 is then inserted from above with its base 12 into the hole in the artificial fingernail. The base 12 is formed by a section of a tube, where cut-outs 14 in the tube wall are provided near the lower edge of the tube. The separate base foot 13 forms a closed cover which, in accordance with one embodiment of this invention, may be made from plastic. The base foot 13 may be flat in the non-inserted state, but can be bent because of its elasticity. Elastic extension 15 in the shape of tube wall segments are formed on the upper surface of this elastic cover. On their exterior these elastic extensions 15 each having on their tops a barb 16, which engages a cut-out 14 in the tube wall of the base 12 when the base foot 13 is inserted into the interior of the base 12. Because the elastic base foot 13 tries to relax out of its bent state after insertion, the barbs are pulled downwardly and thus pull the upper part 11 down flush with the artificial fingernail surface. The positively interlocked connection between the base foot 13 and the upper part 11 is provided in this way.

I claim:

1. A decorative insert for an artificial fingernail comprising: means for immovable insertion of said decorative insert into said artificial fingernail (8), said artificial fingernail having an insertion hole, said means comprising a cylindrical base (1) having an outer diameter to fit said insertion hole, and upper part (2) disposed on said cylindrical base (1) as one of a decoration (4) and a support for said decoration, a lower edge (3) of said upper part (2) projecting radially beyond said cylindrical base (1) and forming two peripheral, connecting S-curves along an exterior surface of said cylindrical base (1), and a base foot (5) connected to a bottom of said cylindrical base (1) having an upper edge (6) which radially extend beyond said cylindrical base (1) at least on two opposite sides.

2. A decorative insert in accordance with claim 1, wherein said base foot (5) is integral with the cylindrical base (1) and has an upper edge (6) extending around the cylindrical base which radially extends beyond the cylindrical base (1) forming two peripheral, connected S-curves along the external surface of the cylindrical base (1) parallel to the lower edge (3) of the upper part (2).

3. A decorative insert in accordance with claim 2, wherein a centered bore into which a magnifying glass has been inserted extends through the decorative insert.

4. A decorative insert in accordance with claim 1, wherein a centered bore into which a magnifying glass has been inserted extends through the decorative insert.

5. A decorative insert in accordance with claim 4, wherein the upper part (2) forming the support for the decoration, has a blind bore forming a mounting into which a precious stone (4) is inserted.

6. A decorative insert in accordance with claim 4, wherein the base foot (13) comprises a separate part, which can be one of secured to the cylindrical base (12) from below and inserted into the cylindrical base (12), and means (14, 15,) for interlocking the cylindrical base (12) and the base foot (13) together.

7. A decorative insert in accordance with claim 6, wherein the decorative insert has a blank area on an upper surface of the upper part (2) for an engraving.

8. A decorative insert in accordance with claim 1, wherein the base foot (13) comprises a separate part, which can be one of secured to the cyclical base (12) from below and inserted into the cylindrical base (12), and means (14, 15) for interlocking the cylindrical base (12) and the base foot (13) together.

9. A decorative insert in accordance with claim 8, wherein the decorative insert has a blank area on an upper surface of the upper part (2) for an engraving.

10. A decorative insert in accordance with claim 1, wherein the decorative insert has a blank area on an upper surface of the upper part (2) for an engraving.

* * * * *